US010465886B1

(12) United States Patent
Liang et al.

(10) Patent No.: US 10,465,886 B1
(45) Date of Patent: Nov. 5, 2019

(54) LIGHT HANGING MECHANISM AND DISPLAY RACK WITH SAME

(71) Applicant: CHANGZHOU EXPOMAX ADVERTISING DISPLAY LIMITED, Changzhou, Jiangsu (CN)

(72) Inventors: Yongjiu Liang, Jiangsu (CN); Yibin Lou, Jiangsu (CN); Yufeng Shao, Jiangsu (CN)

(73) Assignee: CHANGZHOU EXPOMAX ADVERTISING DISPLAY LIMITED, Changzhou, Jiangsu (CN)

( * ) Notice: Subject to any disclaimer, the term of this patent is extended or adjusted under 35 U.S.C. 154(b) by 0 days.

(21) Appl. No.: 16/287,563

(22) Filed: Feb. 27, 2019

(30) Foreign Application Priority Data

Nov. 14, 2018 (CN) ..... 2018 2 1873332 U

(51) Int. Cl.

| | |
|---|---|
| ***F21S 13/02*** | (2006.01) |
| ***F21S 13/12*** | (2006.01) |
| ***F21V 21/08*** | (2006.01) |
| ***A47F 5/10*** | (2006.01) |
| ***A47F 3/00*** | (2006.01) |
| ***F21V 21/22*** | (2006.01) |

(52) U.S. Cl.
CPC ..... *F21V 21/0832* (2013.01); *A47F 3/001* (2013.01); *A47F 5/10* (2013.01); *F21V 21/22* (2013.01)

(58) Field of Classification Search
CPC ..... A47F 3/001; F21V 21/08–32
USPC ..... 362/396, 401–404, 457
See application file for complete search history.

(56) References Cited

U.S. PATENT DOCUMENTS

2010/0118538 A1* 5/2010 Kay ..... F21V 21/28 362/271

* cited by examiner

*Primary Examiner* — Jason M Han
(74) *Attorney, Agent, or Firm* — Hodgson Russ LLP

(57) ABSTRACT

The present disclosure discloses a light hanging mechanism and a display rack having the same. The light hanging mechanism is configured to mount the light on a mounting structure. The light hanging mechanism includes: a casing, defining a receiving cavity therein and provided with a mounting hole; a first adjusting shaft, with one end movably inserting into the receiving cavity through the mounting hole; a positioning portion, movably arranged on the first adjusting shaft and located in the receiving cavity between a locked state and an unlocked state; a mounting base, capable of being connected to the lights and provided with a cooperating portion; and a mounting portion, with at least a portion connected to the casing and at least another portion connected to the mounting structure.

10 Claims, 8 Drawing Sheets

LIGHT HANGING MECHANISM AND DISPLAY RACK WITH SAME

CROSS-REFERENCE TO RELATED APPLICATION

This application claims priority to Chinese Patent Application No. 201821873332.0, filed on Nov. 14, 2018, the entire disclosure of which is incorporated herein by reference.

TECHNICAL FIELD

The present disclosure relates to a light hanging mechanism and a display rack with the same.

BACKGROUND

An existing light hanging mechanism is fixedly connected to a fixing frame through a fixing structure, which is not only unsightly, but also complex during disassembly, resulting in low assembly efficiency, inconvenient maintenance and replacement, disadvantages of high cost of assembly, disassembly and maintenance, and time-consuming assembly.

SUMMARY

The present disclosure aims to solve at least one of the technical problems in the prior art.

Therefore, the present disclosure provides a light hanging mechanism, which provides easy assembly and convenient maintenance and replacement.

The present disclosure also provides a display rack, which provides convenient assembly, disassembly and application.

The light hanging mechanism according to an embodiment of the first aspect of the present disclosure is configured to mount the light on a mounting structure. The light hanging mechanism includes: a casing, defining a receiving cavity therein and provided with a mounting hole in communication with the receiving cavity; a first adjusting shaft, with a first end movably inserting into the receiving cavity through the mounting hole; a positioning portion, movably arranged on the first adjusting shaft between a locked state and an unlocked state and located in the receiving cavity; a mounting base, capable of being connected to the light and provided with a cooperating portion, the cooperating portion extending into the receiving cavity to cooperate with the positioning portion, wherein when the positioning portion is in the unlocked state, the cooperating portion disengages from the positioning portion and the mounting base is detachable with respect to the casing; when the positioning portion is in the locked state, the cooperating portion is connected to the positioning portion and is fastened by the positioning portion, and the mounting base is locked with respect to the casing; and a mounting portion, with at least a portion connected to the casing and at least another portion connected to the mounting structure.

According to the light hanging mechanism of the embodiment of the present disclosure, the light hanging mechanism is connected to the light through the mounting base. When the positioning portion is in the unlocked state, the cooperating portion disengages from the positioning portion, and the light is detached from the mounting structure. When the positioning portion is in the locked state, the cooperating portion is connected to the positioning portion and is fastened by the positioning portion. At this time, the light is mounted on the mounting structure, thereby achieving the purpose of quick installation and displacement of the light. The light hanging mechanism has a simple structure and is convenient for displacement and application, with low maintenance cost.

According to an embodiment of the present disclosure, the positioning portion includes: a fixing portion, provided with a first through hole along a thickness direction thereof, the first end of the first adjusting shaft passing through the first through hole; and a hooking portion, arranged at the fixing portion, wherein when the positioning portion is in the unlocked state, the cooperating portion disengages from the hooking portion, and the mounting base is detachable with respect to the casing; when the positioning portion is in the locked state, the cooperating portion is connected to the hooking portion, and the mounting base is locked with respect to the casing.

According to an embodiment of the present disclosure, the positioning portion further includes: a first elastic member, telescopically arranged between the casing and the fixing portion along an axial direction of the first adjusting shaft.

According to an embodiment of the present disclosure, the hanging mechanism further includes: a pressing portion, arranged outside the casing and screwed to the first adjusting shaft.

According to an embodiment of the present disclosure, a second end of the first adjusting shaft has a size smaller than a size of the mounting hole, and an outer wall of the casing is provided with a notch adapted to the pressing portion along a thickness direction of the casing, the notch having a depth smaller than a thickness of the casing, and the pressing portion is movable along an axial direction of the notch.

According to an embodiment of the present disclosure, the mounting base includes: a mounting body capable of mounting the light, and the cooperating portion is arranged on the mounting body and forming as a bayonet corresponding to the hooking portion.

According to an embodiment of the present disclosure, the casing includes: a bottom plate, provided with the mounting hole along a thickness direction of the bottom plate; a side wall, arranged on a periphery of the bottom plate and provided with an opening communicating with the receiving cavity, wherein the cooperating portion protrudes into the receiving cavity through the opening and is connected to the positioning portion, when the positioning portion is in the locked state; and a rear cover, arranged opposite to the bottom plate and defining the receiving cavity cooperatively with the bottom plate and the side wall.

According to an embodiment of the present disclosure, the side wall is provided with a second through hole opposite to the opening along a thickness direction of the side wall, and the mounting portion includes: a connecting portion, capable of being connected to the mounting structure; a second adjusting shaft, with a first end connected to the connecting portion and a second end extending into the second through hole; and a stop portion, arranged at the second end of the second adjusting shaft and having a size larger than a size of the second through hole.

According to an embodiment of the present disclosure, the mounting portion further includes: a second elastic member, telescopically arranged between the casing and the stop portion along an axial direction of the second adjusting shaft.

The display rack according to an embodiment of the second aspect of the present disclosure includes any one of the above hanging mechanisms for a light. The display rack further includes a display rack body connected to the mounting portion.

Additional aspects and advantages of embodiments of the present disclosure will be given in part in the following descriptions, become apparent in part from the following descriptions, or be learned from the practice of the embodiments of the present disclosure.

BRIEF DESCRIPTION OF THE DRAWING

The above and/or additional aspects and advantages of embodiments of the present disclosure will become apparent and more readily appreciated from the following descriptions made with reference to the drawings, in which.

Figure 1:
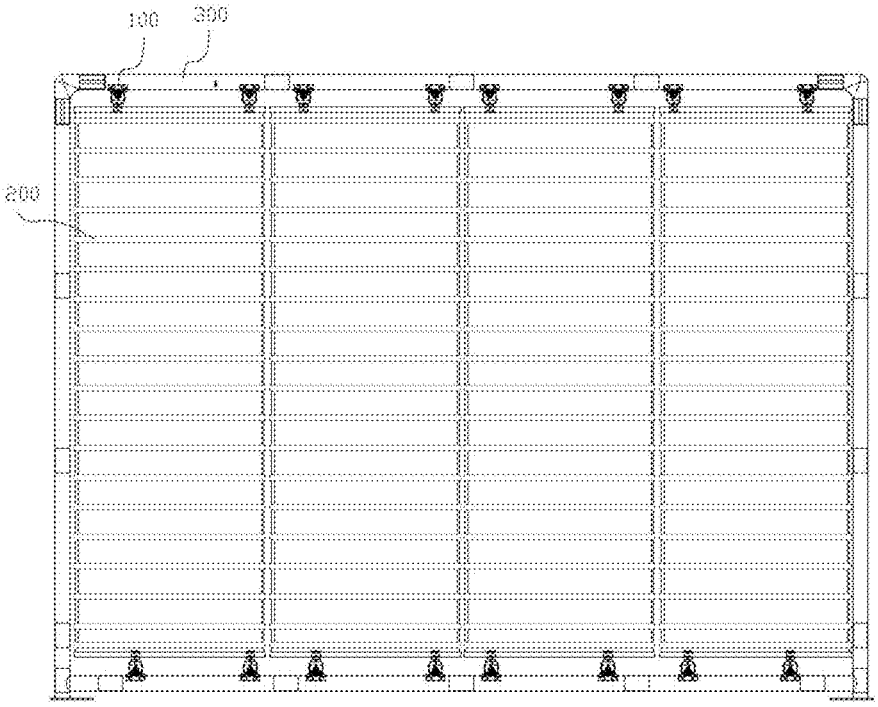
FIG. 1 is a schematic view illustrating assembly of a light hanging mechanism, a light, and a mounting structure according to an embodiment of the present disclosure.

REFERENCE NUMERALS light hanging mechanism 100;
casing 10; receiving cavity 11; mounting hole 12; notch 13; bottom plate 14; side wall 15; rear cover 16; second through hole 17;
first adjusting shaft 20;
positioning portion 30; fixing portion 31; first through hole 32; hooking portion 33; first elastic member 34;
mounting base 40; cooperating portion 41; mounting body 42;
mounting portion 50; connecting portion 51; second adjusting shaft 52; stop portion 53; second elastic member 54;
pressing portion 60;
light 200; mounting structure 300.

DETAILED DESCRIPTION

Embodiments of the present disclosure will be described in detail and examples of embodiments are illustrated in the drawings. The same or similar elements and the elements having the same or similar functions are denoted by like reference numerals throughout the descriptions. Embodiments described herein with reference to drawings are explanatory, serve to explain the present disclosure, and are not construed to limit embodiments of the present disclosure.

In the description of the present disclosure, it should be understood that the orientation or positional relationship indicated by the terms such as "central", "longitudinal", "horizontal", "length", "width", "thickness", "upper", "lower", "front", "rear", "left", "right", "vertical", "horizontal", "top", "bottom", "inner", "outer", "clockwise", "counterclockwise", "axial" and "radial", "circumferential" and the like is based on the orientation or positional relationship shown in the drawings, only for convenience of description of the present disclosure and simplification, and is not intended to indicate or imply that the device or component referred to has a particular orientation, is constructed and operated in a particular orientation, and thus is not to be understood as limiting the present disclosure. In addition, terms such as "first" and "second" are used herein for purposes of description and are not intended to indicate or imply relative importance or significance or to imply the number of indicated technical features. In the disclosure, unless specified otherwise, "a plurality of" means two or more than two.

In the description of the present disclosure, unless specified or limited otherwise, the terms "mounted", "connected", "connected" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

The light hanging mechanism 100 according to embodiments of the present disclosure will be specifically described with reference to the drawings.

As shown in FIG. 1 to FIG. 15, the light hanging mechanism 100 according to embodiments of the present disclosure is configured to mount a light 200 on a mounting structure 300, and the light hanging mechanism 100 includes a casing 10, a first adjusting shaft 20, and a positioning portion 30, a mounting base 40 and a mounting portion 50.

Specifically, the casing 10 defines a receiving cavity 11 therein and is provided with a mounting hole 12 in communication with the receiving cavity 11. The first adjusting shaft 20 has a first end movably inserting into the receiving cavity 11 through the mounting hole 12. The positioning portion 30 is movably arranged on the first adjusting shaft 20 between a locked state and an unlocked state and is located in the receiving cavity 11. The mounting base 40 is capable of connecting the light 200 and is provided with a cooperating portion 41, the cooperating portion 41 extending into the receiving cavity 11 to cooperate with the positioning portion 30. The cooperating portion 41 disengages from the positioning portion 30 when the positioning portion 30 is in an unlocked state, and the mounting base 40 is detachable with respect to the casing 10. The cooperating portion 41 is connected to the positioning portion 30 and is fastened by the positioning portion 30, when the positioning portion 30 is in a locked state, and the mounting base 40 is locked with respect to the casing 10. The mounting portion 50 has at least a portion connected to the casing 10 and at least another portion connected to the mounting structure 300.

In other words, the light hanging mechanism 100 according to an embodiment of the present disclosure is configured to mount the light 200 on the mounting structure 300. The light hanging mechanism 100 mainly includes the casing 10, the first adjusting shaft 20, the positioning portion 30, the mounting base 40 and the mounting portion 50. The casing 10 defines a receiving cavity 12 therein and is provided with a mounting hole 12, and the mounting hole 12 is in communication with the receiving cavity 11. The first end of the first adjusting shaft 20 extends into the receiving cavity 11 through the mounting hole 12. The first adjusting shaft 20 is movable along the axial direction of the mounting hole 12, and the positioning portion 30 is arranged in the receiving cavity 11 and is located on the first adjusting shaft 20. The casing 10 is provided with the mounting base 40 on a side, and the casing 10 can be connected to the light 200 through the mounting base 40. The mounting base 40 may be provided with a cooperating portion 41. The cooperating portion 41 may extend into the receiving cavity 11 and cooperate with the positioning portion 30. When the positioning portion 30 is in an unlocked state, the cooperating portion 41 is disengaged from the positioning portion 30. At this time, the mounting base 40 is detachable with respect to the casing 10. When the positioning portion 30 is in a locked state, the cooperating portion 41 is connected to the positioning portion 30 and fastened by means of the positioning portion 30. At this time, the mounting base 40 is locked with respect to the casing 10. The mounting portion 50 is connected to the casing 10, and the casing 10 can be mounted on the mounting structure 300 by the mounting portion 50.

Therefore, the light hanging mechanism 100 according to an embodiment of the present disclosure adopts a device combined with the casing 10, the first adjusting shaft 20, the positioning portion 30, the mounting base 40 and the mounting portion 50, which not only realizes the installation of the light onto the mounting structure 300, but also provides the advantages that assembly and disassembly are convenient, installation time can be saved, assembly efficiency can be raised, and maintenance cost can be lowered.

Figure 13:
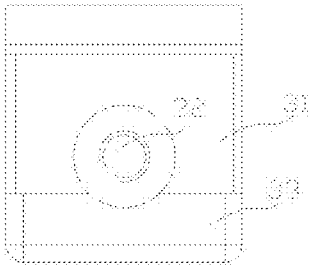
FIG. 13 is a schematic view illustrating a fixing portion of a light hanging mechanism according to an embodiment of the present disclosure.
Figure 14:
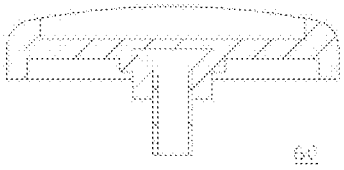
FIG. 14 is a schematic view illustrating a pressing portion of a light hanging mechanism according to an embodiment of the present disclosure.
Figure 15:
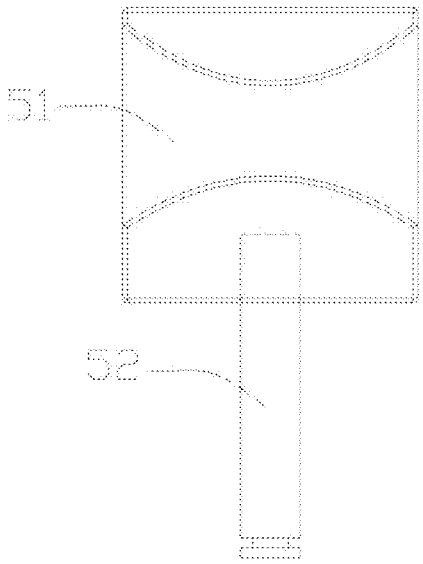
FIG. 15 is a schematic view illustrating a mounting portion of a light hanging mechanism according to an embodiment of the present disclosure.

As shown in FIG. 13, according to an embodiment of the present disclosure, the positioning portion 30 includes a fixing portion 31 and a hooking portion 33.

Specifically, the fixing portion 31 is provided with a first through hole 32 along a thickness direction thereof, the first end of the first adjusting shaft 20 passes through the first through hole 32, and an interference fit may be provided between the fixing portion 31 and the first adjusting shaft 20. The hooking portion 33 is arranged at the fixing portion 31. When the positioning portion 30 is in an unlocked state, the cooperating portion 41 disengages from the hooking portion 33, and the mounting base 40 is detachable with respect to the casing 10. When the positioning portion 30 is in a locked state, the cooperating portion 41 is connected to the hooking portion 33, and the mounting base 40 is locked with respect to the casing 10. The hooking portion 33 cooperates with the cooperating portion 41, achieving a simple structure and easy operation.

It should be noted that the fixing portion 31 may also be provided with a boss, which is located on the same side with the hook portion 33. When the hook portion 33 is reset, the boss may abut against the casing, which improves the stability of the hook portion 33 and prolongs the service life of the hook portion 33.

Figure 2:
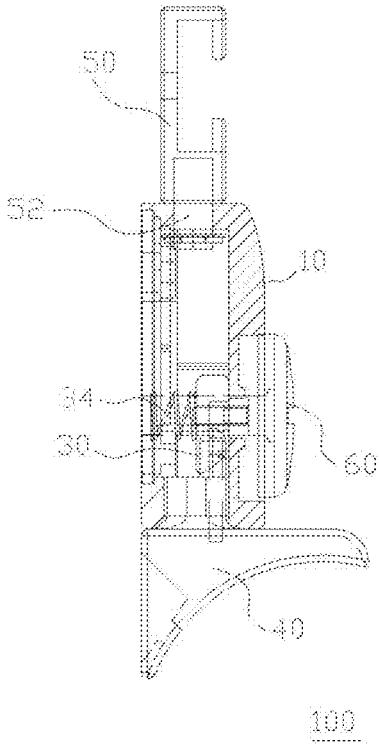
FIG. 2 is a schematic view illustrating a light hanging mechanism according to an embodiment of the present disclosure.
Figure 3:
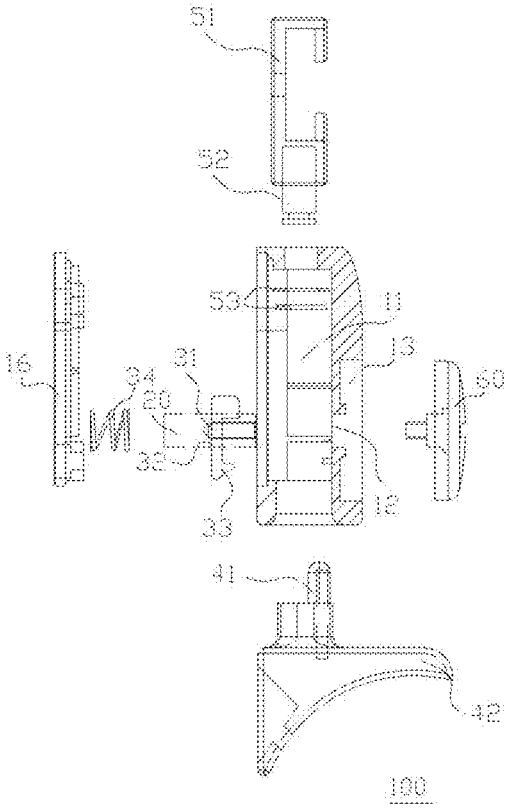
FIG. 3 is an exploded view of FIG. 2.

As shown in FIG. 2 and FIG. 3, the positioning portion 30 further includes a first elastic member 34. The first elastic member 34 is telescopically arranged between the casing 10 and the fixing portion 31 along an axial direction of the first adjusting shaft 20. The hooking portion 33 may be automatically reset by means of the first elastic member 34.

Figure 4:
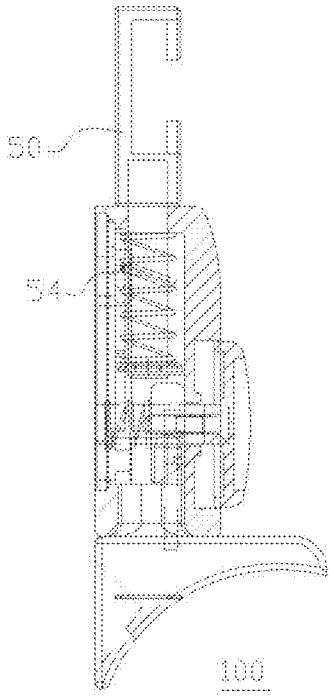
FIG. 4 is a schematic view illustrating a light hanging mechanism according to another embodiment of the present disclosure.
Figure 5:
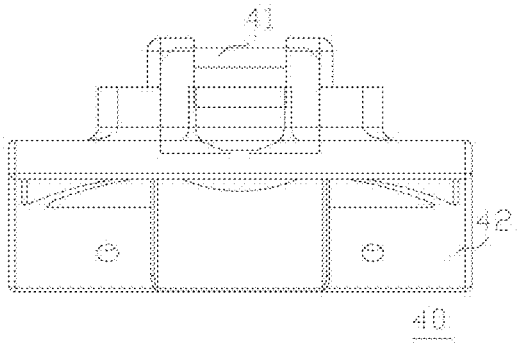
FIG. 5 is a front view illustrating a mounting base of a light hanging mechanism according to an embodiment of the present disclosure.
Figure 6:
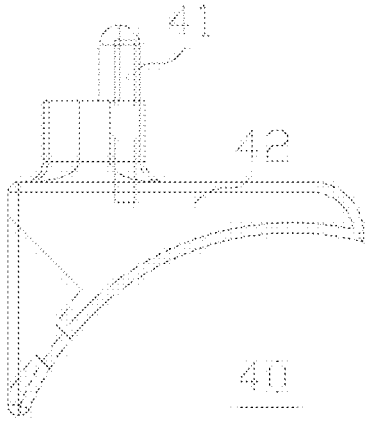
FIG. 6 is a left view illustrating the mounting base of the light hanging mechanism according to the embodiment of the present disclosure.
Figure 7:
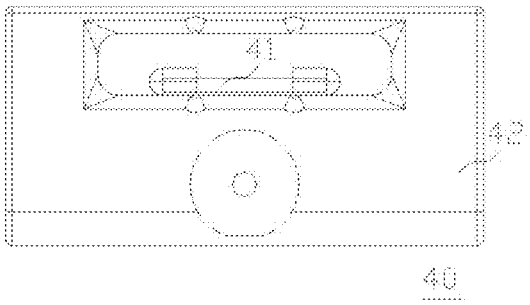
FIG. 7 is a top view illustrating the mounting base of the light hanging mechanism according to the embodiment of the present disclosure.
Figure 8:
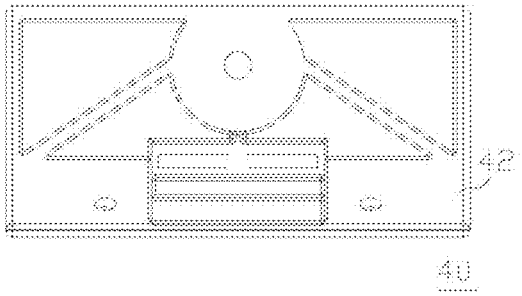
FIG. 8 is a bottom view illustrating the mounting base of the light hanging mechanism according to the embodiment of the present disclosure.

As shown in FIG. 2 to FIG. 4, in some embodiments of the present disclosure, the light hanging mechanism 100 further includes a pressing portion 60, the pressing portion 60 is arranged outside the casing 10 and is screwed to the first adjusting shaft 20. An operator can adjust and control the position of the positioning portion 30 by pressing the pressing portion 60, to control the positioning portion 30 to be in a locked state or in an unlocked state.

Further, a second end of the first adjusting shaft 20 has a size smaller than a size of the mounting hole 12. An outer wall of the casing 10 is provided with a notch 13 along the thickness direction thereof, and the notch 13 is adapted to the pressing portion 60. The notch 13 has a depth smaller than a thickness of the casing 10, and the pressing portion 60 is movable along an axial direction of the notch 13, which not only has good appearance, but also prevents the pressing portion 60 from over-protruding from the outer surface of the casing 10 to scrape nearby objects.

As shown in FIG. 5 to FIG. 8, according to an embodiment of the present disclosure, the mounting base 40 includes a mounting body 42, and the mounting body 42 can be used for mounting the light 200. The cooperating portion 41 is arranged on the mounting body 42 and forms as a bayonet corresponding to the hooking portion 33.

Figure 9:
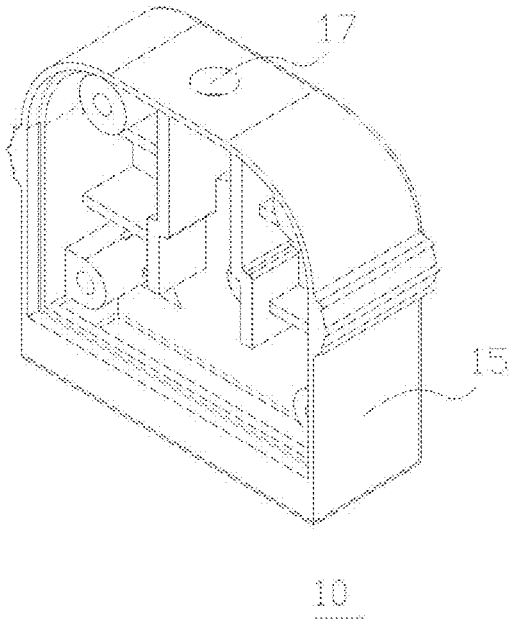
FIG. 9 is a perspective view illustrating a casing of a light hanging mechanism according to an embodiment of the present disclosure.
Figure 10:
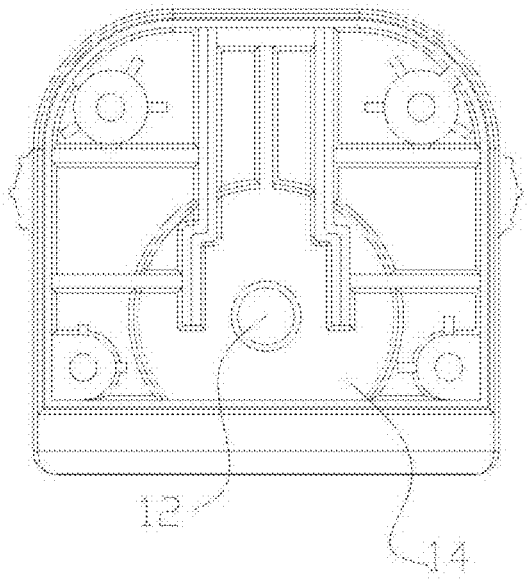
FIG. 10 is a front view illustrating the casing of the light hanging mechanism according to the embodiment of the present disclosure.
Figure 11:
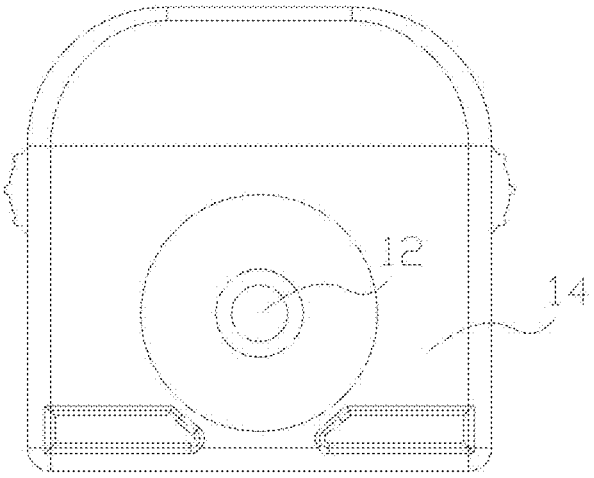
FIG. 11 is a rear view illustrating the casing of the light hanging mechanism according to the embodiment of the present disclosure.
Figure 12:
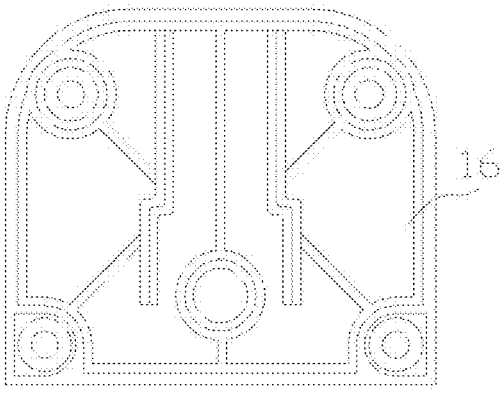
FIG. 12 is a schematic view illustrating a rear cover of a light hanging mechanism according to an embodiment of the present disclosure.

As shown in FIG. 9 to FIG. 11, in some specific embodiments of the present invention, the casing 10 includes a bottom plate 14, a side wall 15 and a rear cover 16.

Specifically, the bottom plate 14 is provided with the mounting hole 12 along a thickness direction thereof. The side wall 15 is arranged on a periphery of the bottom plate 14 and is provided with an opening communicating with the receiving cavity 11. The cooperating portion 41 protrudes into the receiving cavity 11 through the opening and is connected to the positioning portion 30, when the positioning portion 30 is in a locked state. The rear cover 16 is arranged opposite to the bottom plate 14 and defining the receiving cavity 11 cooperatively with the bottom plate 14 and the side wall 15. The rear cover 16 may be fixed to the casing 10 via a self-tapping screw. It should be noted that the rear cover 16 may be define a through hole at position corresponding to the first adjusting shaft 20. When the second end of the first adjusting shaft 20 is pushed, the first end of the first adjusting shaft 20 may pass through the through hole and move.

Further, the side wall 15 is provided with a second through hole 17 arranged opposite to the opening in the thickness direction thereof, and the mounting portion 50 includes a connecting portion 51, a second adjusting shaft 52 and a stop portion 53.

Specifically, the connecting portion 51 can be connected to the mounting structure 300, A first end of the second adjusting shaft 52 is connected to the connecting portion 51, and a second end of the second adjusting shaft 52 extends into the second through hole 17. The stop portion 53 is arranged at the second end of the second adjusting shaft 52 and has a size larger than a size of the second through hole 17. The stop portion 53 may include a flat washer and a split washer.

It should be noted that a guide portion may be provided on an inner wall surface of the casing 10, and the guide portion may be arranged on peripheries of the fixing portion 31 and the second adjusting shaft 52 and be adapted to shapes of the fixing portion 31 and the second adjusting shaft 52.

As shown in FIG. 4, optionally, the mounting portion 50 further includes a second elastic member 54 which is telescopically arranged between the casing 10 and the stop portion 53 in the axial direction of the second adjusting shaft 52.

That is, as shown in FIG. 2 and FIG. 4, when the mounting portion 50 does not includes the second elastic member 54, the connection between the connecting portion 51 and the mounting structure 300 is rigidly and not adjustable. When the mounting portion 50 includes the second elastic member 54, the connection between the connecting portion 51 and the mounting structure 300 is softly and adjustable.

As shown in FIG. 1, the display rack according to an embodiment of the present disclosure includes any one of the above light hanging mechanism 100. The display rack further includes: a display rack portion which is embodied as the mounting structure 300, and the display rack portion is connected with the mounting portion 50. The light 200 may be a diffuse reflection light curtain, the diffuse reflection light curtain is combined with the display rack via the light hanging mechanism 100, so as to give the display rack a light effect. After a screen is placed, the display effect is better and the appearance is improved.

The assembly process and assembly features of the light hanging mechanism 100 according to an embodiment of the present disclosure are specifically described as follows.

Figure 16:
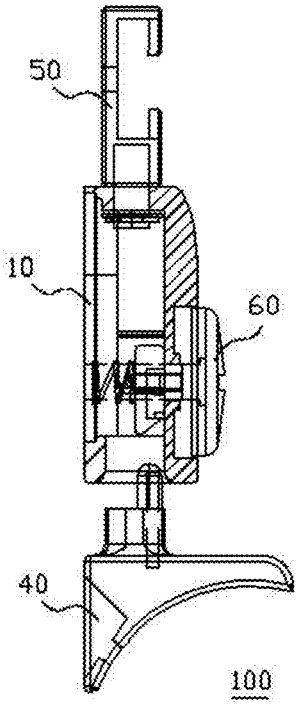
FIG. 16 is a schematic view illustrating an installation step S1 of a light hanging mechanism according to an embodiment of the present disclosure.

S1. As shown in FIG. 16, the mounting base 40 is preassembled.

Figure 17:
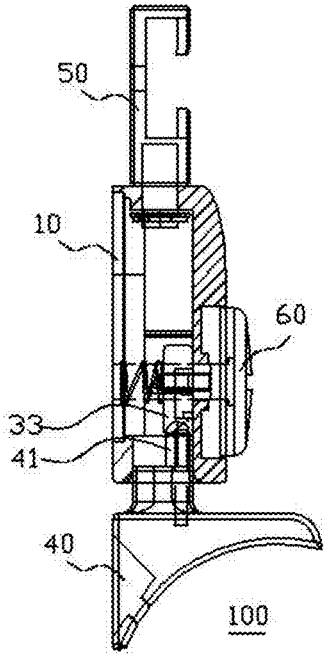
FIG. 17 is a schematic view illustrating an installation step S2 of the light hanging mechanism according to an embodiment of the present disclosure.

S2. As shown in FIG. 17, the mounting base 40 is pushed to slide inwards the receiving chamber 11, and the cooperating portion 41 is in contact with an inclined surface of the hooking portion 33.

Figure 18:
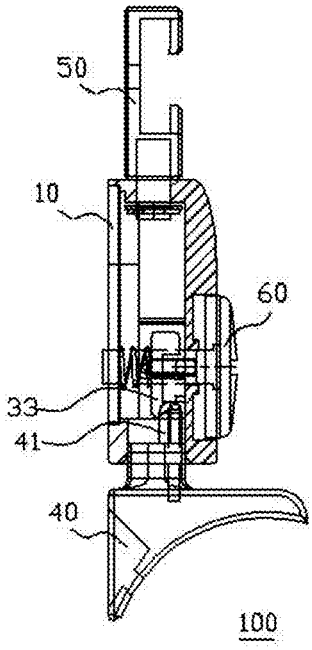
FIG. 18 is a schematic view illustrating an installation step S3 of the light hanging mechanism according to an embodiment of the present disclosure.

S3. As shown in FIG. 18, the mounting base 40 is pushed continually to slide inwards the receiving cavity 11, and the more the mounting base 40 moves inward, the greater the force on the hooking portion 33 will be.

Figure 19:
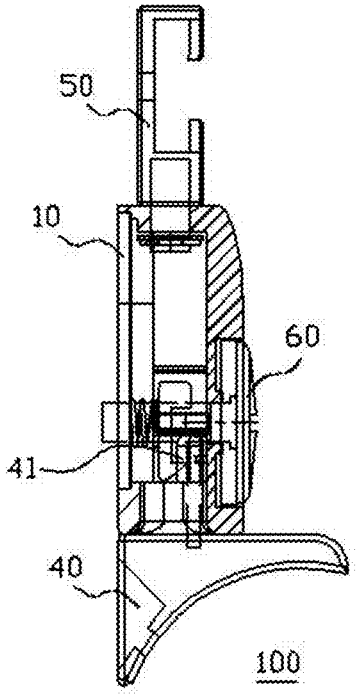
FIG. 19 is a schematic view illustrating an installation step S4 of the light hanging mechanism according to an embodiment of the present disclosure.

S4. As shown in FIG. 19, the mounting base 40 is in place, and the hooking portion 33 slides rearward.

Figure 20:
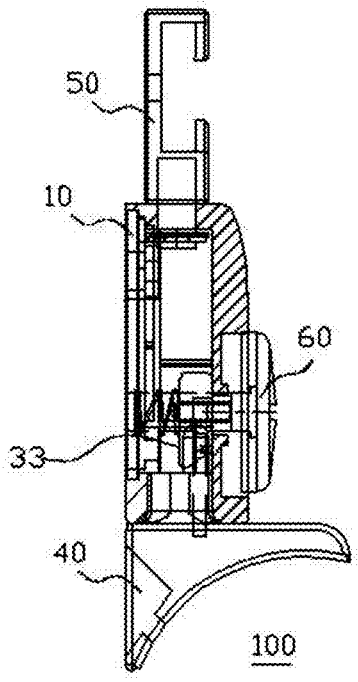
FIG. 20 is a schematic view illustrating an installation step S5 of the light hanging mechanism according to an embodiment of the present disclosure.

S5. As shown in FIG. 20, when the hooking portion 33 passes over the cooperating portion 41, the first elastic member 34 is returned, pushing the hooking portion 33 forward to catch the cooperating portion 41.

When unlocking, all that is needed is to press the pressing portion 60, and the hook portion 33 is pushed backward, such that the hooking portion 33 and the cooperating portion 41 are gradually disengaged to complete unlocking.

In summary, the light hanging mechanism 100 according to the embodiment of the present disclosure has the cooperating portion 41 and the positioning portion 30 cooperated. When the positioning portion 30 is in an unlocked state, the mounting base 40 is detachable with respect to the casing 10. When the positioning portion 30 is in a locked state, the mounting base 40 is locked with respect to the casing 10. Therefore, a light can be quickly mounted and dismounted, achieving the advantages of high work efficiency and the like.

The display rack according to an embodiment of the present disclosure includes the light hanging mechanism 100 according to the above embodiments. Since the light hanging mechanism 100 according to the embodiments of the present disclosure has the above technical effects, the display rack according to the embodiment of the present disclosure also has corresponding technical effects. That is, the display rack may effectively improve holding force, fixing reliability and disassembly convenience.

In the description of the present disclosure, reference throughout this specification to "an embodiment," "some embodiments," "an example," "a specific example," or "some examples," means that a particular feature, structure, material, or characteristic described in connection with the embodiment or example is comprised in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples. Without a contradiction, the different embodiments or examples and the features of the different embodiments or examples can be combined by those skilled in the art.

Although explanatory embodiments have been illustrated and described, it would be appreciated by those skilled in the art that the above embodiments are exemplary and cannot be construed to limit the present disclosure, and changes, modifications, alternatives and varieties can be made in the embodiments by those skilled in the art without departing from scope of the present disclosure.

What is claimed is:

1. A light hanging mechanism configured to mount a light on a mounting structure, comprising:

a casing, defining a receiving cavity therein and provided with a mounting hole in communication with the receiving cavity;

a first adjusting shaft, with a first end movably inserting into the receiving cavity through the mounting hole;

a positioning portion, movably arranged on the first adjusting shaft between a locked state and an unlocked state and located in the receiving cavity;

a mounting base, capable of being connected to the light and provided with a cooperating portion, the cooperating portion extending into the receiving cavity to cooperate with the positioning portion, wherein when the positioning portion is in the unlocked state, the cooperating portion disengages from the positioning portion and the mounting base is detachable with respect to the casing; when the positioning portion is in the locked state, the cooperating portion is connected to the positioning portion and is fastened by the positioning portion, and the mounting base is locked with respect to the casing; and a mounting portion, with at least a portion connected to the casing and at least another portion connected to the mounting structure.

2. The light hanging mechanism according to claim 1, wherein the positioning portion comprises:

a fixing portion, provided with a first through hole along a thickness direction thereof, the first end of the first adjusting shaft passing through the first through hole; and a hooking portion, arranged at the fixing portion, wherein when the positioning portion is in the unlocked state, the cooperating portion disengages from the hooking portion, and the mounting base is detachable with respect to the casing; when the positioning portion is in the locked state, the cooperating portion is connected to the hooking portion, and the mounting base is locked with respect to the casing.

3. The light hanging mechanism according to claim 2, wherein the positioning portion further comprises:

a first elastic member, telescopically arranged between the casing and the fixing portion along an axial direction of the first adjusting shaft.

4. The light hanging mechanism according to claim 2, further comprising:

a pressing portion, arranged outside the casing and screwed to the first adjusting shaft.

5. The light hanging mechanism according to claim 4, wherein a second end of the first adjusting shaft has a size smaller than a size of the mounting hole, and an outer wall of the casing is provided with a notch adapted to the pressing portion along a thickness direction of the casing, the notch having a depth smaller than a thickness of the casing, and the pressing portion is movable along an axial direction of the notch.

6. The light hanging mechanism according to claim 2, wherein the mounting base comprises:

a mounting body, capable of mounting the light, the cooperating portion being arranged on the mounting body and forming as a bayonet corresponding to the hooking portion.

7. The light hanging mechanism according to claim 1, wherein the casing comprises:

a bottom plate, provided with the mounting hole along a thickness direction of the bottom plate;

a side wall, arranged on a periphery of the bottom plate and provided with an opening communicating with the receiving cavity, wherein the cooperating portion protrudes into the receiving cavity through the opening and is connected to the positioning portion, when the positioning portion is in the locked state; and a rear cover, arranged opposite to the bottom plate and defining the receiving cavity cooperatively with the bottom plate and the side wall.

8. The light hanging mechanism according to claim 7, wherein the side wall is provided with a second through hole opposite to the opening along a thickness direction of the side wall, and the mounting portion comprises:

a connecting portion, capable of being connected to the mounting structure;

a second adjusting shaft, with a first end connected to the connecting portion and a second end extending into the second through hole; and a stop portion, arranged at the second end of the second adjusting shaft and having a size larger than a size of the second through hole.

9. The light hanging mechanism according to claim 8, wherein the mounting portion further comprises:

a second elastic member, telescopically arranged between the casing and the stop portion along an axial direction of the second adjusting shaft.

10. A display rack, comprising:

a light hanging mechanism, the light hanging mechanism comprising:

a casing, defining a receiving cavity therein and provided with a mounting hole in communication with the receiving cavity;

a first adjusting shaft, with a first end movably inserting into the receiving cavity through the mounting hole;

a positioning portion, movably arranged on the first adjusting shaft between a locked state and an unlocked state and located in the receiving cavity;

a mounting base, capable of being connected to a light and provided with a cooperating portion, the cooperating portion extending into the receiving cavity to cooperate with the positioning portion, wherein when the positioning portion is in the unlocked state, the cooperating portion disengages from the positioning portion and the mounting base is detachable with respect to the casing; when the positioning portion is in the locked state, the cooperating portion is connected to the positioning portion and is fastened by the positioning portion, and the mounting base is locked with respect to the casing; and a mounting portion, with at least a portion connected to the casing and at least another portion connected to the mounting structure, and a display rack portion, connected to the mounting portion.

* * * * *